United States Patent [19]

Unuma

[11] Patent Number: 4,961,526

[45] Date of Patent: Oct. 9, 1990

[54] PAPER FEEDER

[75] Inventor: Sadao Unuma, Aichi, Japan

[73] Assignee: Tokai Kogyo Kabushiki Kaisha, Oobu, Japan

[21] Appl. No.: 349,249

[22] Filed: May 9, 1989

[30] Foreign Application Priority Data

May 10, 1988 [JP] Japan ..... 63-112894

[51] Int. Cl.[5] ..... B65H 20/20; B41J 11/30

[52] U.S. Cl. ..... 226/74; 400/616.2

[58] Field of Search ..... 226/74, 75; 254/391; 474/133, 101, 111; 400/616.1, 616.2

[56] References Cited

U.S. PATENT DOCUMENTS

| | | | |
|---|---|---|---|
| 152,270 | 6/1874 | Bird | 254/391 |
| 1,636,273 | 7/1927 | Baker | 254/391 |
| 4,453,660 | 6/1984 | Cornell et al. | 226/74 |

*Primary Examiner*—Daniel P. Stodola
*Assistant Examiner*—Paul Thomas Bowen
*Attorney, Agent, or Firm*—Wenderoth, Lind & Ponack

[57] ABSTRACT

A paper feeder has a pair of spaced opposed side frames, a driving sprocket having external teeth on the outer circumferential surface thereof and a supporting shaft on which the driving sprocket is mounted and rotably mounted between the two side frames, and an endless feed belt having a portion around the driving sprocket and having feed pins on the outer circumferential surface and engageable with perforations in perforated paper, and having internal teeth on the inner circumferential surface thereof meshed with the external teeth for being turned by the driving sprocket. A pair of ring members is pivotably mounted around the ends of the rotary shaft at opposite ends of the driving sprocket and each having an arcuate friction wall thereon extending to a position opposed to the outer surface of the portion of the feed belt extending around the sprocket with a clearance between the inner surface of the friction wall and the outer surface of the feed belt, and a belt engaging member on the ring member extending to a position spaced just outwardly of the portion of the feed belt as it comes off the driving sprocket.

3 Claims, 9 Drawing Sheets

PAPER FEEDER

FIELD OF UTILIZATION OF THE INVENTION

This invention relates to a paper feeder having a feed belt the feed pins which are fitted in the perforations of perforated paper, and a driving sprocket for moving this feed belt so as to feed the perforated paper, and more particularly to a paper feeder capable of preventing the slackening of a feed belt which causes the feed belt to resonate, dance and slip, and having an improved perforated paper feeding accuracy.

PRIOR ART

The paper feeders constructed with a feed belt extended between a pair of side frames and wrapped around a driving sprocket are divided into two main groups.

A paper feeder belonging to one group has driving sprockets support rotatably via shafts on two pairs of opposed end potions of a pair of side frames, and a feed belt extending around the sprockets which has internal teeth meshed with the external teeth of the sprockets, one driving sprocket being driven to turn the feed belt.

A paper feeder belonging to the other group has a driving sprocket supported rotatably via a shaft on a pair of opposed end portions of a pair of side frames, a linearly extending belt receiver provided between the side frames so as to bend arcuately at the other opposed end portions thereof, and a feed belt extending around the driving sprocket and the arcuately bent portion of the belt receiver, the driving sprocket being driven to turn the feed belt.

In the former paper feeder, rotational sliding resistance occurs at each of the driving sprocket supporting portions. In the latter paper feeder, rotational sliding resistance occurs at the sprocket supporting portion, and sliding resistance between the arcuately extending portion of the belt receiver and the tips of the internal teeth of the feed belt.

In both of these paper feeders, a feed belt 82 extends around the sprockets or around a sprocket and a belt receiver in a slightly slackened state as shown in FIG. 14, so as not to be greatly tensioned. Namely, these paper feeders are designed so that the sliding resistance is thereby minimized to enable the feed belt 82 to be turned with the lowest possible rotational torque.

When perforated paper is fed at a high speed, a linearly moving non-paper-feed portion of the feed belt 82 is slackened in some cases as shown in FIGS. 15 and 16, so as to be oscillated like a string and to resonate. This resonation causes positive and negative acceleration to occur repeatedly in the linearly moving paper-feed portion of the feed belt 82. Consequently, the paper feed speed of the paper-feed portion of the feed belt 82 varies slightly, so that the paper feed accuracy is reduced. This influences the typewriting portion of a printer to cause a decrease in the typewriting accuracy.

The slack provided on the feed belt so as to minimize the sliding resistance occuring therein is concentrated at an arcuately moving portion, which is meshed with the driving sprocket 86, of the feed belt 82 while the resonance thereof occurs, and the engagement of the internal teeth 84 of the feed belt 82 with the external teeth 88 of the driving sprocket 86 is loosened. This causes the portion of the feed belt 82 which is meshed with the driving sprocket 86 to slip momentarily in some cases.

In order that the endless feed belt 82 can be deformed easily, the internal teeth 84 provided thereon are formed with the smallest possible height and pitch, and tapered acutely so that the internal teeth 84 are meshed easily with the external teeth 88 of the driving sprocket 86.

When the feed belt 82 is moved by the driving sprocket 86 to feed the perforated paper 90 in the direction of the arrow as shown in FIG. 17, a reaction force works on the feed belt 82 in the direction opposite to the direction shown by the arrow. This reaction force works on the portion of the feed belt 82 which is meshed with the driving sprocket 86 so that the internal teeth 84 of this portion of the feed belt 82 are pushed out along the tapering surfaces of the external teeth 88 of the driving sprocket 86.

Owing to a combination of the push-out effect of the reaction force working on the feed belt 82 and the effect of the centrifugal force occurring when the feed belt 82 is turned coaxially with the driving sprocket 86, the arcuately moving portion of the feed belt 82, which is meshed with the driving sprocket 86, is pushed in the radially outward direction to float, so that the depth of meshing of the internal teeth 84 of the feed belt 82 with the external teeth 88 of the driving sprocket 86 decreases. If the quantity of push-out of the feed blet 82 exceedy the depth of meshing of the teeth 84, 88, a slippage occurs between the driving sprocket 86 and feed belt 82.

The driving sprocket 86 and feed belt 82 are so designed that the depth of meshing of the external teeth 88 of the former and the internal teeth 84 of the latter and the quantity of slack of the feed belt 82 normally have a relation which does not cause a slippage to occur between the driving sprocket 86 and feed belt 82. However, when the perforated paper is fed at a high speed by the feed belt 82 which is formed out of a flexible resin, a resonating phenomenon occurs in the feed belt 82, so that a large force is applied momentarily to the feed belt 82. As a result, the feed belt 82 is stretched, and this gives rise to a slippage between the teeth of the feed belt 82 and those of the driving sprocket 86.

Thus, in a paper feeder using a feed belt, the feed belt is apt to slip due to both a resonating phenomenon occurring therein because of slack in the feed belt, and a reaction force imparted to the feed belt during a paper feed operation.

When a slippage occurs between the feed belt and driving sprocket, the feed pins on the feed belt and the perforations in the perforated paper do not properly engage each other. Consequently, the feed accuracy of the perforated paper is reduced, and the stagnation and breakage of the perforated paper readily occur.

In FIGS. 14–17, reference numeral 92 denotes a side frame, 94 a belt receiver provided on the side frame 92, and **94*a* an arcuately extended portion at one end section of the belt receiver 94**.

OBJECTS AND BRIEF SUMMARY OF THE INVENTION

A first object of the present invention is to improve the paper feed accuracy by preventing the resonance, dancing and slipping of the feed belt by utilizing the floating, which occurs due to the slackening of the feed belt, of the arcuately moving portion of the belt.

A second object of the present invention is to feed perforated paper smoothly by preventing the breakage of the peripheral portions and stagnation of the perforated paper which occur in a conventional paper feeder due to the resonance, dancing and slipping of the feed belt therein.

To this end of the present invention provides a paper feeder having an endless feed belt which is provided on the outer circumferential surface thereof with feed pins projecting outward therefrom and engaged with the perforations in the perforated paper, and on the inner circumferential surface thereof with internal teeth, and which is disposed between a pair of side frames so that the feed belt can be turned, and a driving sprocket provided with external teeth on the outer circumferential surface thereof, supported rotatably via a shaft between the two side frames and meshed with the internal teeth on an arcuately turning portion of the feed belt, the feed belt being turned by the driving sprocket to feed the perforated paper, characterized in that a pair of ring members are installed pivotally in the portions of the side frames which are aligned axially with the rotary shaft of and on both sides of the driving sprocket, each of which ring members is provided with an arcutate friction wall formed integrally therewith and extending to a position on the outer side of the paper feed surface of the arcuately turning portion of the feed belt with a clearance of a predetermined width left between the inner surface of the friction wall and this paper feed surface, and a belt holder formed integrally with the ring member and extending to a position just under a linearly moving portion of the non-paper-feed section of the feed belt. When the feed belt resonates or dances to cause the arcuately turning portion thereof meshed with the driving sprocket to float, the paper feed surface of the feed belt and the opposed surfaces of the friction walls contact each other, so that the ring members are turned in the rotational direction of the driving sprocket due to the frictional force of these contacting surfaces with the belt holders, which are formed integrally with the ring members and extended to positions just under the linearly moving portion of the non-paper-feed section of the feed belt, pressing the linearly-moving portion of the feed belt.

Thus, the resonation and dancing of feed belt are prevented, and the portion of the feed belt which is moved around the driving sprocket does not float. The ring members are then turned in the direction opposite to the rotational direction of the driving sprocket, to return to their original positions.

The above and other objects, advantages and features of the present invention will be fully understood from the following description.

DETAILED DESCRIPTION OF THE INVENTION

Figure 1:
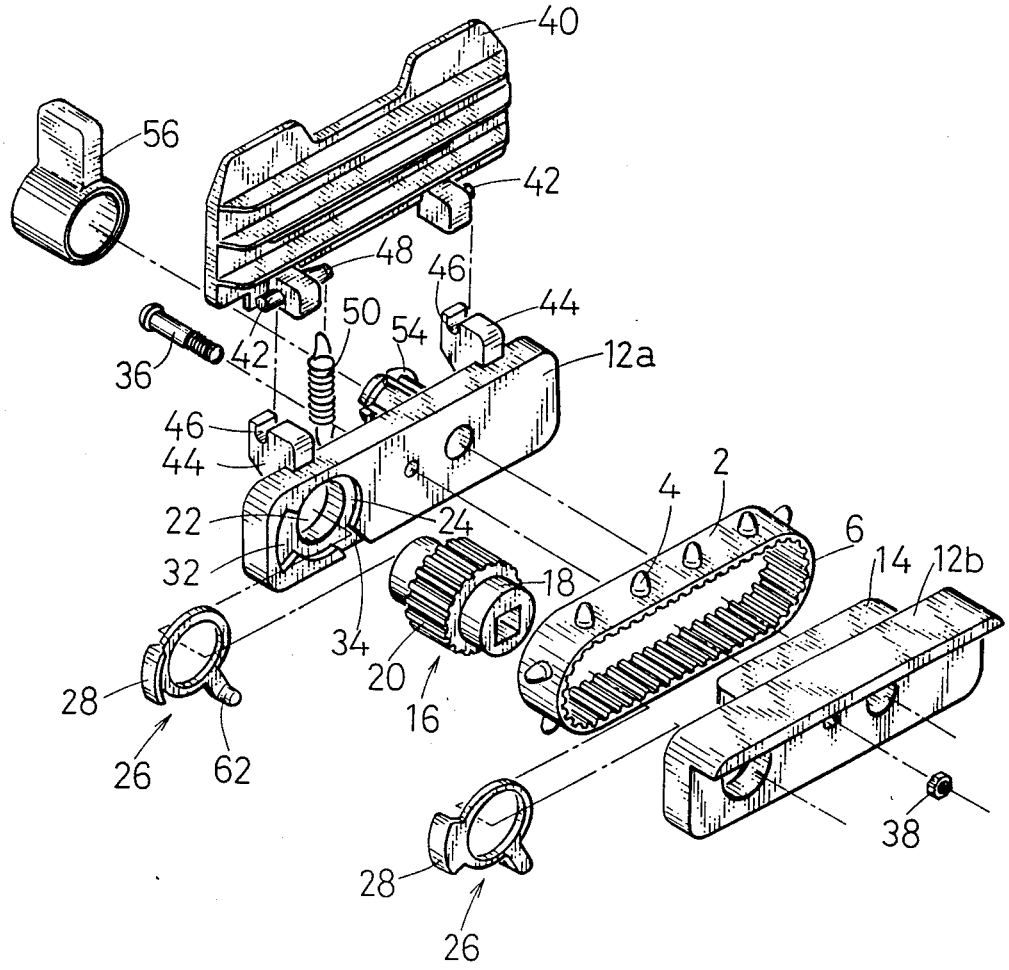
FIG. 1 is a perspective exploded view of the paper feeder according to the present invention.

First, a paper feeder 1 as a whole will be described, and then the ring members 26, the characteristic parts of the present invention will be described.

Referring to FIGS. 1–5, and endless feed belt 2 is formed out of a flexible resin, and provided with a plurality of feed pins 4 projecting at a predetermined pitch from the outer circumferential surface thereof, and internal teeth 6 on the inner circumferential surface thereof.

The pitch of the feed pins 4 projecting from the outer circumferential surface of the feed belt 2 is set in agreement with that of the perforations 10 (refer to FIG. 13) formed in both edge portions of a stop of perforated paper 8.

A belt receiver 14 is formed on the inner side surface of a side frame **12*b*, and one end portion of this belt receiver 14** is arcuately formed.

A driving sprocket 16 is provided with external teeth 20 on a larger-diameter portion formed at the intermediate section of a rotary shaft 18.

A pair of side frames **12*a*, 12*b* are provided at one of two opposite end portions thereof with sprocket bores 22 in which the rotary shaft 18 of the driving sprocket 16 is inserted and supported. The two side frames 12*a*, 12*b* are further provided in the portions of the inner side surfaces thereof which are opposed to each other with annular recesses 24 extending coaxially with the sprocket bores 22. At the outer circumference of each of the annular recesses 24, a friction wall receiving recess 32 and an arm receiving recess 34 are formed, which are used to receive therein a friction wall 28 and an arm 30, respectively, which are formed intergrally with a ring member 26**.

The ring members 26 are fitted around the rotary shaft 18 of the driving sprocket 16 so that the ring members 26 are disposed on both sides of the external teeth 20 of the driving sprocket 16, and the rotary shaft 18 of the driving sprocket 16 is then inserted into the sprocket bores 22 in the side framess 12, **12*b*. As a result, the ring members 26 are fitted in the annular recesses 24, and the driving sprocket 16 is supported rotatably between the two side frames 12, 12***b*.

Figure 10:
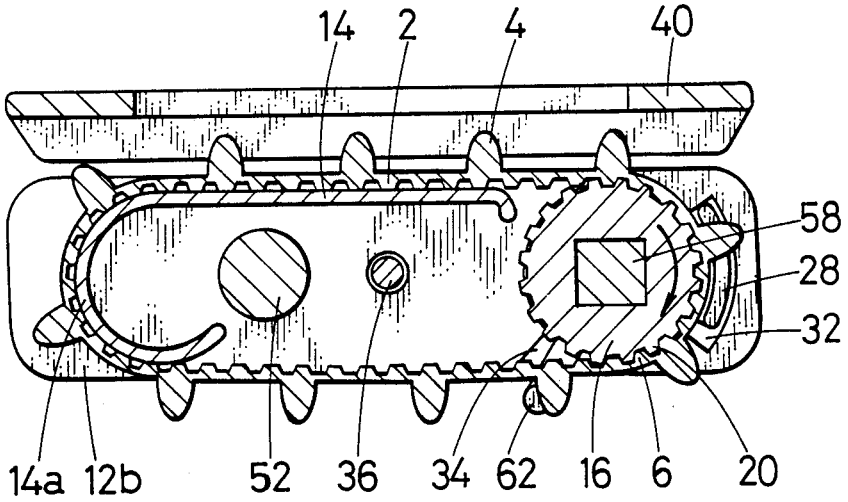
FIG. 10. is a sectional view taken along the line 10—10 in FIG. 5.

As shown in FIG. 10, the feed belt 2 is wrapped around the driving sprocket 16 and an arcuate portion 14*a* of belt receiver 14 provided on one side frame 12*b*.

The pair of side frames 12, 12*b* are recured to each other by a connecting bolt 36 and a nut 38.

A pair of fulcrum shafts 42 are provided at one side ede portion of a cover 40 so that the fulcrum shafts 42 are spaced from each other by a predetermined distance in the direction of movement of the feed belt. The side frame 12*a* is provided at both end portions with cover receivers 44 having grooves 46, in which the fulcrum shafts 42 provided on the cover 40 are inserted.

Figure 4:
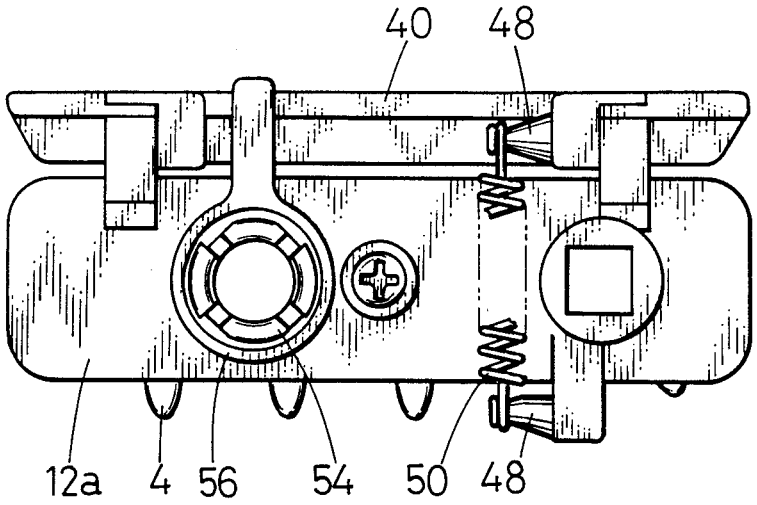
FIG. 4 is a front elevation of the paper feeder according to the present invention.

As shown in FIGS. 1 and 4, spring arms 48 are provided on one end portion of the cover 40 and lower end portion of the side frame 12*a*, and a tension spring 50 is a hooked on these spring arms 48.

The cover 40 is adapted to be moved pivotally around the fulcrum shafts 42 so that the cover 40 is opened and closed with respect to the side frames 12*a*, 12*b*. While the cover 40 is closed, it is urged in the closing direction by the tensile force of the tension sprind 50.

This cover 40 has the function of preventing the floating of the perforated paper 8 fed by the feed pins 4 engaged with the perforations 10, as well as the function of absorbind a high force applied to the cover 40 when something unusual occurs during a paper feed operation, for example, when perforated paper of a thickness greater than a set thickness, or locally wrinkled or folded perforated paper is fed, in which cases the cover 40 is opened against the resilient force of the spring 50 to absorb the high force.

The side frame 12*a* is provided with a tightener 54 for tightening against a support pipe 52 inserted therethrough, and a lock member 56 is engaged with this tightener 54 to fix the paper feeder 1 to the support pipe 52.

Figure 13:
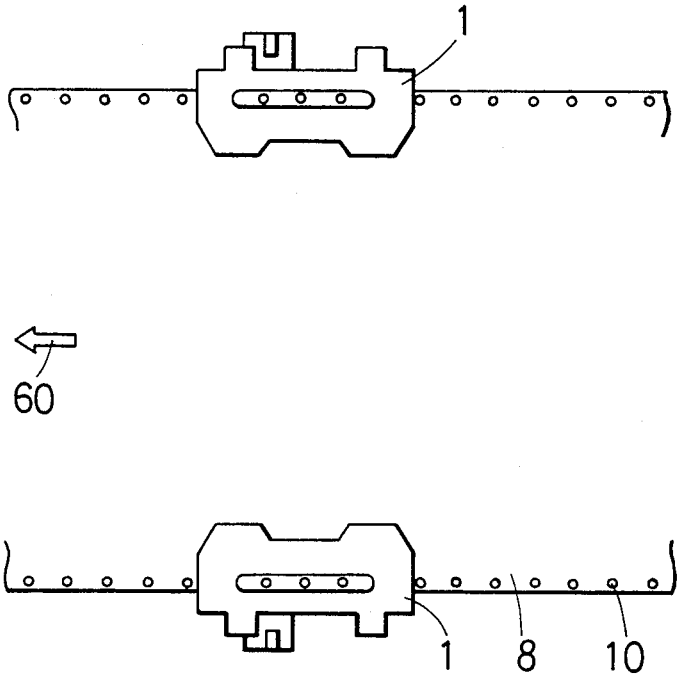
FIG. 13 is a plan view of perforated paper which is being fed by a pair of paper feeders 1.
Figure 14:
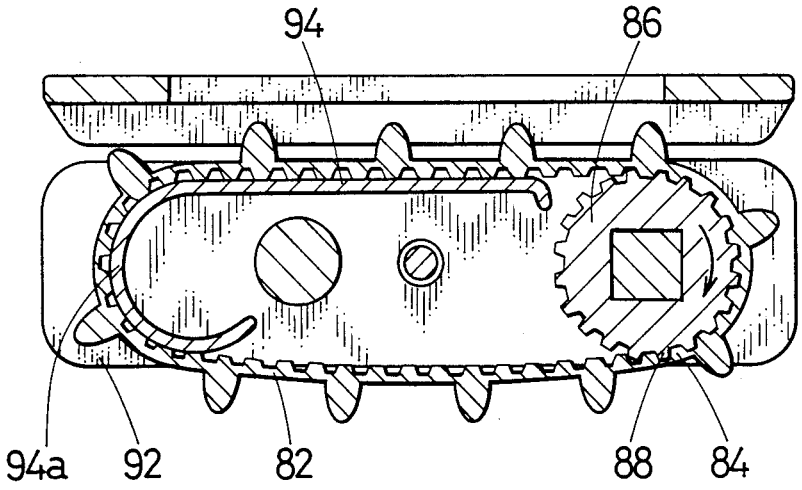
FIG. 14 (PRIOR ART)
FIG. 14 is a sectional view of a conventional paper feeder in which a feed belt 82 is wrapped around a driving sprocket 86 and an arcuately extended end portion **94*a* of a belt receiver 94 with the feed belt 82** having a predetermined degree of slack.
Figure 15:
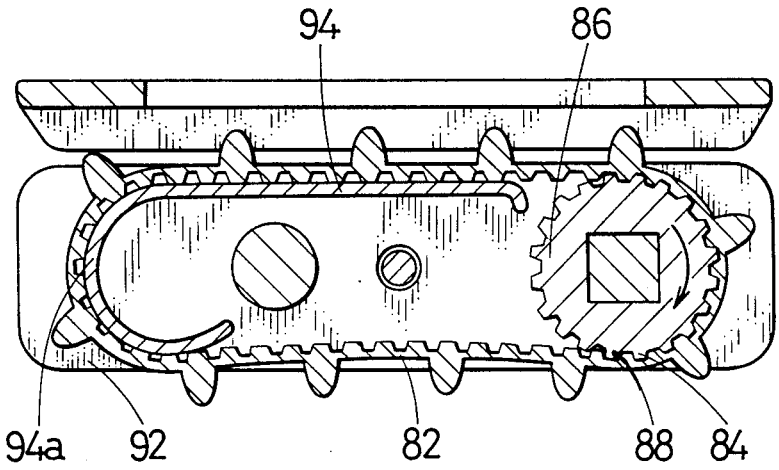
FIG. 15 (PRIOR ART)
FIGS. 15 and 16 are sectional views of the conventional paper feeder showing how resonance occurs in the linearly moving non-paper-feed portion of the feed belt 82.
Figure 16:
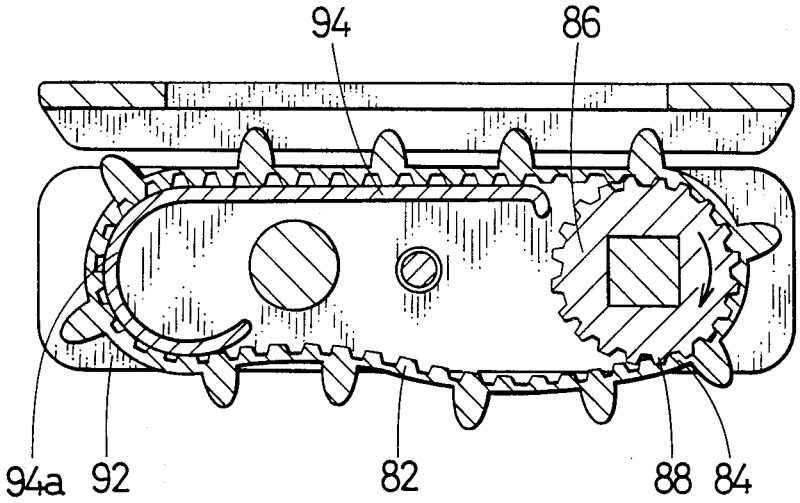
FIG. 16 (PRIOR ART)
Figure 17:
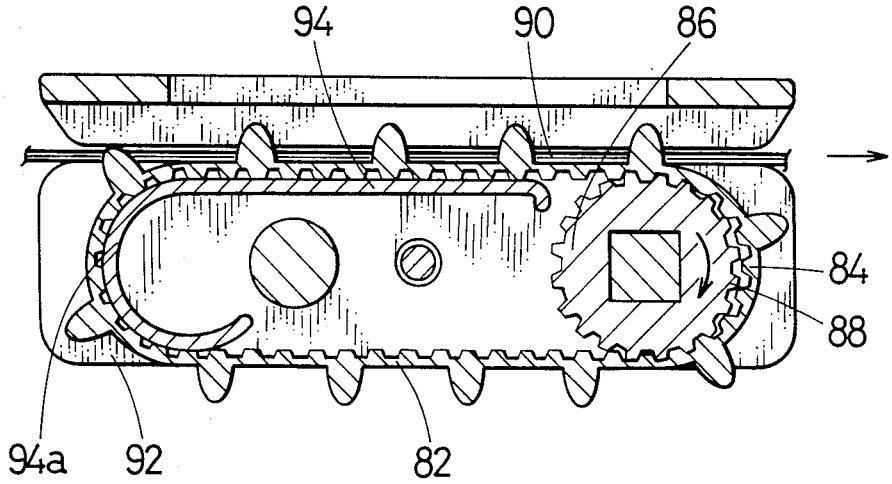
FIG. 17 (PRIOR ART)
FIG. 17 is a sectional view of the conventional paper feeder in which the portion of the feed belt 82 which is around the driving sprocket 86 floats.

As shown in FIG. 13, a pair of paper feeders 1 are fixed to support pipes 52 so that they are spaced by a distance corresponding to the width of the perforated paper 8 with the feed pins 4 on the feed belts 2 engaged with the perforations 10 formed in both edge portions of the perforated paper 8. When a driving shaft 58 is rotated to move the feed belt 2 by the driving sprocket 16, the perforated paper 8 is sent in a widthwise tensioned state by the feed belt 2 in the direction of the arrow 60.

Figure 2:
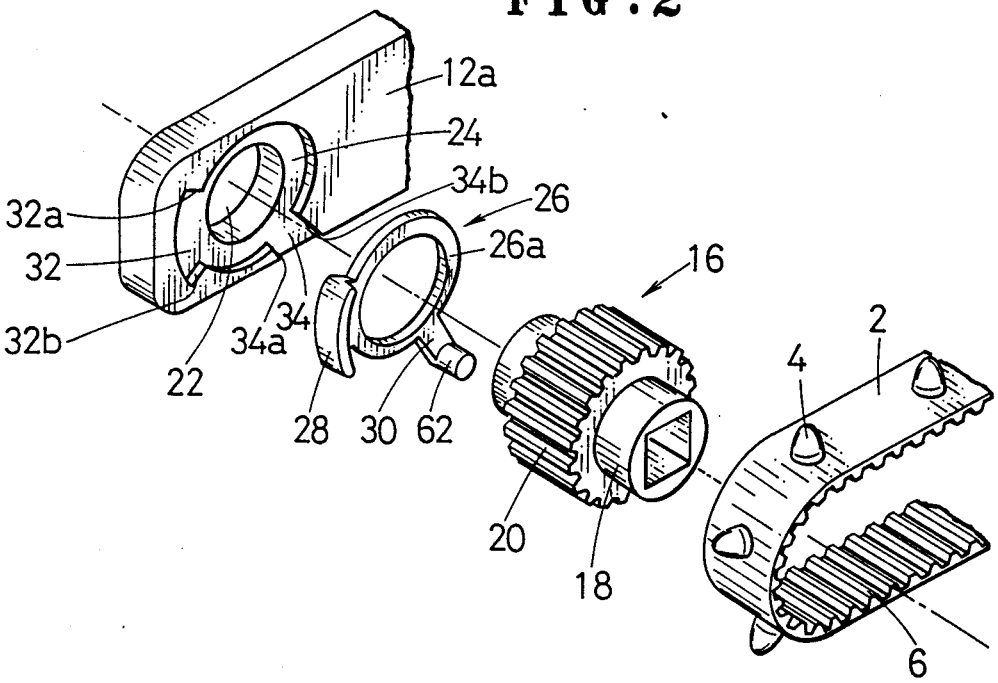
FIG. 2 is an enlarged exploded perspective view of a principal portion of the paper feeder of FIG. 1.
Figure 3:
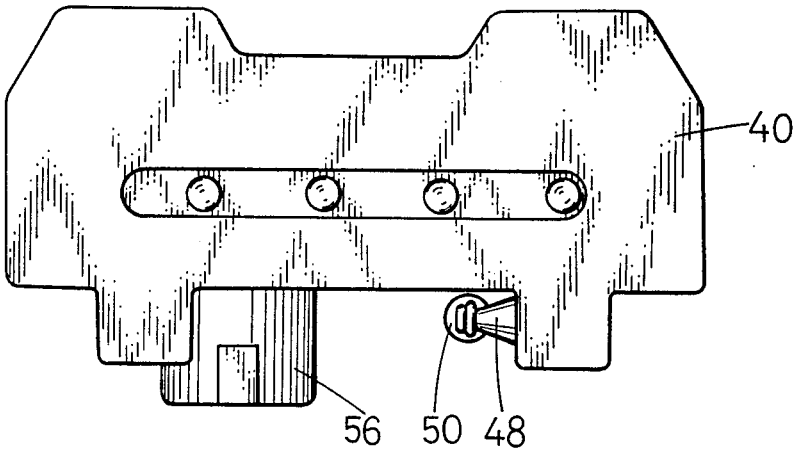
FIG. 3 is a plan view of the paper feeder according to the present invention.

As shown in detail in FIG. 2, each ring members 26 consists of a ring body 26*a*, an arcuate friction wall 28 formed integrally with the ring body 26*a* and projecting from the ring in a direction parallel to the axis thereof, an arm 30 extending radially from the ring body 26*a*, and a cylindrical belt engagement member 62 projecting from the outer end of the arm 30 in the direction in which the friction wall 28 projects and by substantially the same amount. It is desirable that this ring member 26 be formed out of an engineering plastic having abrasion resistance.

A pair of ring members 26 are mounted pivotably on the rotary shaft 18 of the driving sprocket 16, and the ring bodies 26*a*, friction walls 28 and arms 30 of the ring members 26 are inserted in the annular recesses 24, friction wall receiving recesses 32 and arm receiving recesses 34, respectively, provided in the side frames 12*a*, 12*b*. The friction wall 28 and the member 62 project past the surface of the side frame toward the opposite side frame and lie outside the paper feed surface 2*a* of the feed belt 2.

Figure 6:
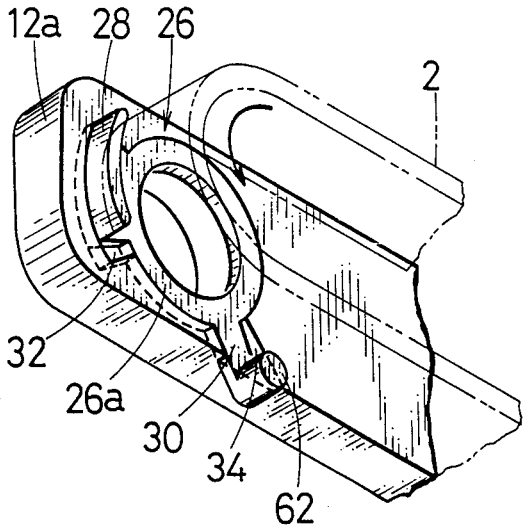
FIG. 6 is a partial perspective view of a side frame of the paper feeder and showing a portion of a feed belt 2 which is moving in a non-floating state around a driving sprocket 16.
Figure 7:
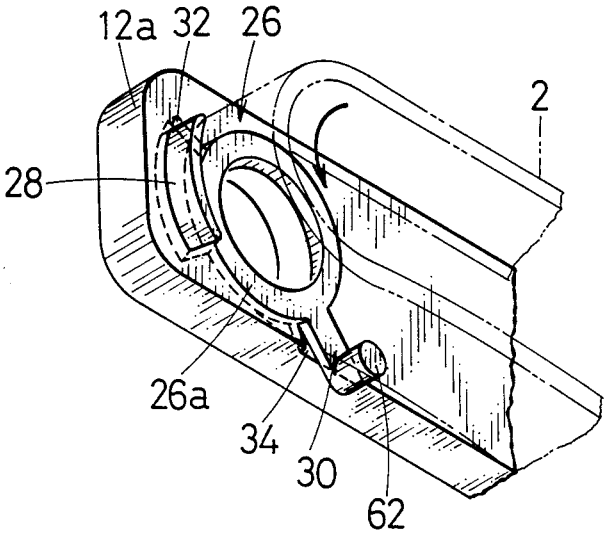
FIG. 7 is a partial perpective view similar to FIG. 6 moving the portion of the feed belt 2 in a floating state.
Figure 8:
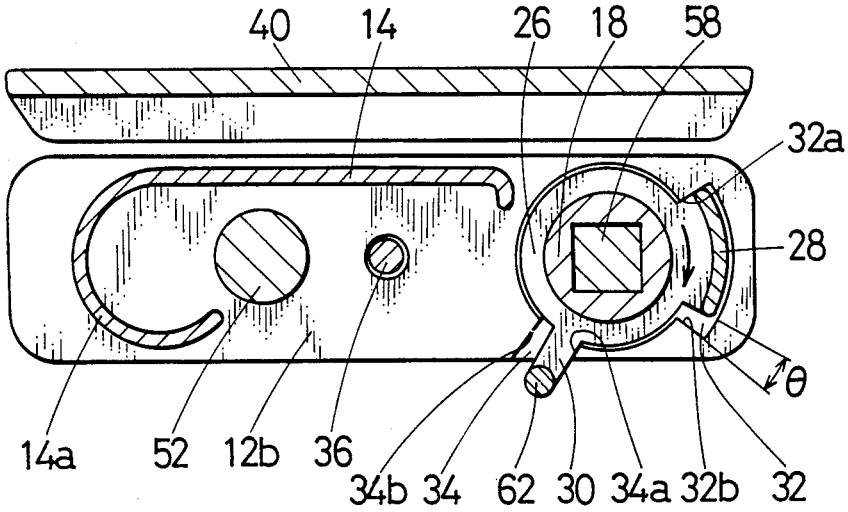
FIG. 8 is a sectional view taken along the line 8—8 in FIG. 5.

As shown in FIGS. 6–8, the friction wall 28 and arm 30 of a ring member 26 are inserted loosely in the friction wall receiving recess 32 and arm receiving recess 34. Accordingly, the ring member 26 can be turned through a set angle $\theta$ around the axis of rotation of the driving sprocket 16.

While the arcuately moving portion of the feed belt 2 is in a normal condition in which the feed belt is not floated to any great degree, a rotational force in the direction oppposite to the direction in which the driving sprocket 16 is rotated occurs in the ring member 26 due to the weight unbalance of the ring member 26 with respect to the center thereof. Therefore, the friction wall 28 and arm 30 are engaged with an end surface 32*a* of the friction wall receiving recess 32 and a side surface 34*a* of the arm inserting recess 34, respectively, serving as stopping surfaces as shown in FIGS. 6 and 8.

When the arcuately moving portion of the feed belt 2 floats to a sufficient degree as will be described later, the paper feed surface 2*a* thereof contacts the friction walls 28, and the ring members 26 are turned as they are drawn in the rotational direction of the driving sprocket 16 due to the frictional engagement of the paper feed surface 2*a* and friction walls 28. However, since the friction walls 28 and arms 30 are formed so that they contact the end surfaces 32*b* in the friction wall receiving recesses 32 and the side surfaces 34*b* in the arm receiving recesses 34, they are not turned in excess of the set angle $\theta$. Thus, the end surfaces 32*b* in the friction wall receiving recesses 32 and the side surfaces 34*b* in the arm receiving recesses 34 function as stoppers for the ring members 26.

The feed belt 2 is put in the space between a pair of side frames 12*a*, 12*b* and wrapped around the driving sprocket 16 and the arcuate portion 14*a* of the belt receiver 14 with a predetermined degree of slack left in the feed belt 2 for the reasons given in detail in the introductory portion hereof. The internal teeth 6 of the feed belt 2 and the external teeth 20 of the driving sprocket 16 are meshed with each other around the driving sprocket 16.

The positional relation of the friction wall 28 and belt engaging member 62, which are formed integrally with the corresponding ring member 26, with respect to the feed belt 2 is as follows.

Figure 11:
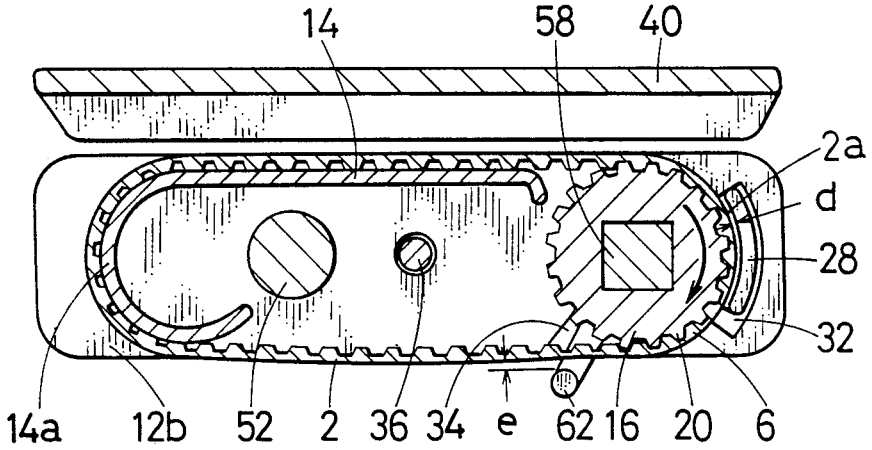
FIG. 11. is a sectional view taken along the line 11—11 in FIG. 5 showing the feed belt 2 having no floating portions.

When the feed belt 2 is meshed with the driving sprocket 16 with the feed belt not floated above the sprocket as shown in FIG. 11, a clearance d of a predetermined width is formed between the paper feed surface 2*a* of the feed belt 2 and the friction wall 28, and a clearance e of a predetermined width between the belt engaging member 62 and the lower surface of the linearly moving portion on the non-paper-feed portion of the feed belt 2. The width of the clearance d between the paper feed surface 2*a* of the feed belt 2 and the friction wall 28 is smaller than the depth of meshing of the external teeth 20 of the driving sprocket 16 with the internal teeth 6 of the feed belt 2.

The belt engaginhg members 62 are formed so as to contact the lower surface of the linearly moving portion on the non-paper-feed portion of the feed belt 2.

Figure 5:
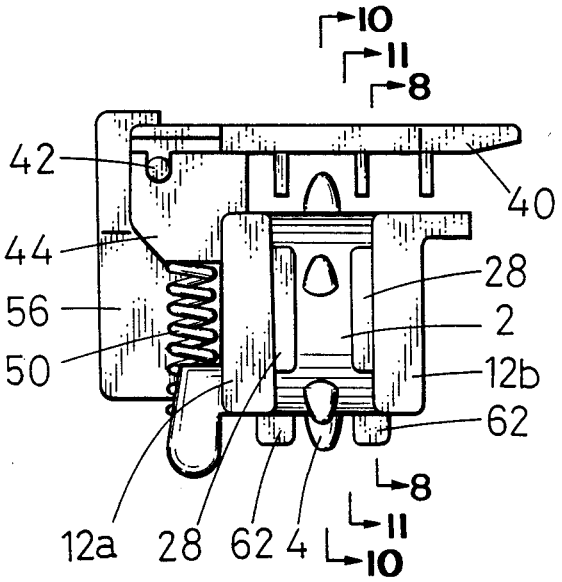
FIG. 5 is an end elevation of the paper feeder according to the present invention.
Figure 9:
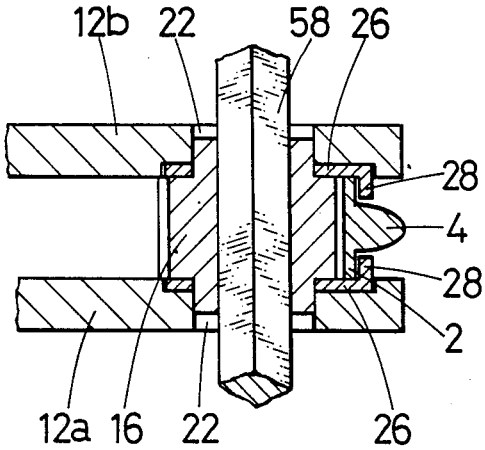
FIG. 9 is a sectional plan of the driving sprocket 16.

As shown in FIGS. 5 and 9, the widths of the frictions walls 28 and belt engaging members 62 on the ring members 26 are such that the friction walls 28 and belt holders 62 do not interfere with the feed pins 4 provided on the widthwise intermediate portion of the feed belt 2.

The driving sprocket 16 is rotated intermittently to turn the feed belt 2, whereby the perforated paper 8 is sent intermittently a predetermined distance thereby.

When the perforated paper 8 is fed intermittently at a high speed, a large reaction force is applied to the feed belt 2, and this causes in some cases the linearly moving portion on the non-paper-feed portion of the feed belt 2 to resonate or dance, and the arcuately moving portion, which is meshed with the driving sprocket 16, of the feed belt 2 to float to a significant degree.

Figure 12:
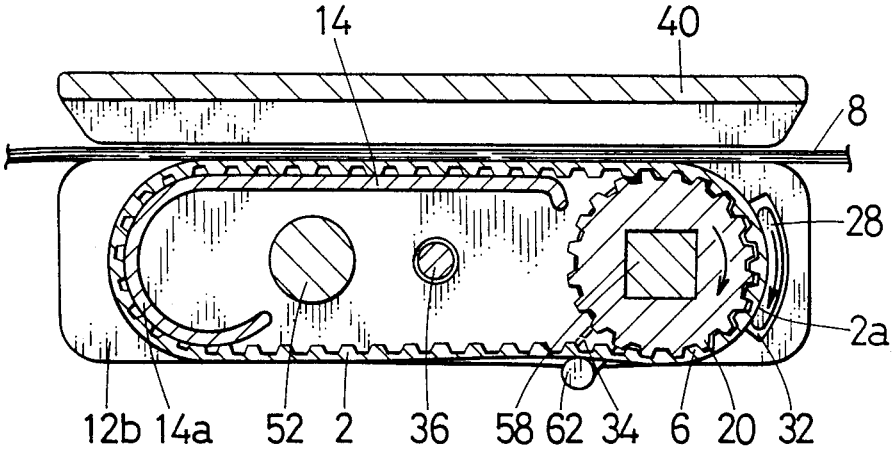
FIG. 12 is a sectional view similar to FIG. 11 showing the feed belt 2 having a floating portion.

As shown in FIG. 12, when the arcuately moving portion of the feed belt 2 floats to such an extent that it is in excess of the width of the clearance d between the paper feed surface 2*a* of the feed belt 2 and the friction walls 28, the feed belt 2 contacts the friction walls 28 to prevent the arcuately moving portion of the feed belt 2 from being further floated, and the ring members 26 are drawn and turned in the rotational direction of the driving sprocket by the frictional force occuring due to the contacting of the paper feed surface 2*a* of the feed belt 2 and the friction walls 28.

When the ring members 26 are drawn and turned through the set angle $\theta$, the friction walls 28 and arms 30 engage the end surfaces 32*b* in the friction wall receiving recesses 32 and the end surfaces 34*b* in the arm receiving recesses 34, respectively, to prevent the ring members 26 from being further drawn and turned.

When the ring members 26 are drawn and turned in the direction of rotation of the driving sprocket 16, the belt engaging members 62 provided integrally with the ring members 26 press the linearly moving portion on the non-paper-feed portion of the feed belt 2 from the lower side thereof, whereby the resonance and dancing of the feed belt 2 are provided.

The angle of pivotal movement of the ring members 26 when the feed belt 2 is floated around the driving sprocket 16 depends upon the quantity of slack of the feed belt 2, and it is possible that the friction walls 28 and arms 30 of the ring members 26 stop in the midst of their turning movements without engaging the end surfaces 32*b* in the friction wall receiving recesses 32 and the end surfaces 34*b* in the arm receiving recesses 34, respectively.

When the linearly moving portion on the non-paper-feed portion of the feed belt 2 is pressed by the belt engaging members 62 of the ring members 26, the problem of floating of the feed belt 2 occuing around the driving sprocket 16 is solved. Consequently, the paper feed surface 2*a* of the feed belt 2 separates from the friction walls 28, and the ring members 26 are turned in the direction opposite to the direction of rotation of the driving sprocket 16 to return to their original positions.

When the feed belt 2 resonates or dances during the feeding of the perforated paper, the above-described effects of the ring members 26 are produced instantly. Therefore, the resonance or dancing of the feed belt 2 stops instantly, and the slipping of the feed belt 2 around the driving sprocket 1 does not occur. Since the resonance, dancing and slipping of the feed belt are thus prevented, the paper feed speed of the feed belt becomes constant. Accordingly, the accuracy of engaging the perforations of the perforated paper and the feed pins on the feed belt with each other is improved, and this enables the accuracy of feeding the perforated paper to be improved.

If the belt engaging members provided on the ring members are formed like rollers, the contact resistance thereof with respect to the feed belt can be reduced.

I claim:

1. A paper feeder comprising:

a pair of spaced opposed side frames;

a driving sprocket having extenal teeth on the outer circumferential surface thereof and a supporting shaft on which said driving sprocket is mounted and rotably mounted between said two side frames;

an endless feed belt having a portion around said driving sprocket and having feed pins on the outer circumferential surface projecting outward therefrom and engageble with perforations in perforated paper, and having internal teeth on the inner circumferential surface thereof meshed with said external teeth for being turned by said driving sprocket to feed perforated paper; and a pair of ring member pivotably mounted around the ends of said supporting shaft at opposite ends of said driving sprocket, each of said ring members having an arcuate friction wall thereon extending to a position opposed to the outer circumferential surface of said portion of said feed belt extending around said sprocket with a predetermined clearance between the inner circumferential surface of said friction wall and the outer circumferential surface of said feed belt, and a belt engaging member on said ring member and extending to a position spaced just outwardly of the portion of said feed belt as it comes off said driving sprocket in a direction in which said feed belt is driven by said driving sprocket.

2. A paper feeder as claimed in claim 1 further comprising a stop means operatively associated with each of said ring members and with which said ring members is engagable for preventing said ring members from being turned through a rotational angle in excess of a predetermined angle in the direction of rotation of said driving sprocket.

3. A paper feeder as claimed in claim 2 in which each said ring member has a weight distribution of said friction wall and said belt engaging member for, when said friction wall is not engaged by said feed belt, pivoting around said driving sprocket supporting shaft in a direction opposite to the directioin of rotation thereof to move said belt engaging member away from said feed belt, and further stop means for preventing said ring member from being turned in a rotational angle in excess of a predetermined angle in the direction opposite the direction of rotation of said sprocket supporting shaft.

* * * * *